US011333417B2

(12) United States Patent
Sharma et al.

(10) Patent No.: US 11,333,417 B2
(45) Date of Patent: May 17, 2022

(54) EVAPORATOR ASSEMBLY FOR A VERTICAL FLOW TYPE ICE MAKING MACHINE

(71) Applicants: Ram Prakash Sharma, Haryana (IN); Vinay Sharma, Haryana (IN)

(72) Inventors: Ram Prakash Sharma, Haryana (IN); Vinay Sharma, Haryana (IN)

( * ) Notice: Subject to any disclaimer, the term of this patent is extended or adjusted under 35 U.S.C. 154(b) by 126 days.

(21) Appl. No.: 16/646,276

(22) PCT Filed: Nov. 27, 2018

(86) PCT No.: PCT/IB2018/059331
§ 371 (c)(1),
(2) Date: Mar. 11, 2020

(87) PCT Pub. No.: WO2019/106524
PCT Pub. Date: Jun. 6, 2019

(65) Prior Publication Data

US 2020/0278143 A1 Sep. 3, 2020

(30) Foreign Application Priority Data

Nov. 28, 2017 (IN) ..... 201711042696

(51) Int. Cl.
*F25C 1/12* (2006.01)
*F25C 5/10* (2006.01)

(52) U.S. Cl.
CPC ..... *F25C 1/12* (2013.01); *F25C 5/10* (2013.01); *F25C 2305/022* (2013.01);
(Continued)

(58) Field of Classification Search
CPC ..... F25C 1/12; F25C 5/10; F25C 2305/022; F25C 2400/02; F25C 2400/04;
(Continued)

(56) References Cited

U.S. PATENT DOCUMENTS 4,555,913 A * 12/1985 Ishiguro ..... F25C 1/12 62/347
5,038,573 A 8/1991 McAllister
(Continued)

FOREIGN PATENT DOCUMENTS

CN 1890518 A 1/2007
CN 101983308 A 3/2011
(Continued)

OTHER PUBLICATIONS

International Application No. PCT/IB2018/059331, International Preliminary Report on Patentability, completed Mar. 16, 2020 with attached Response to Written Opinion of the International Preliminary Examining Authority filed Dec. 23, 2019.
(Continued)

*Primary Examiner* — Cassey D Bauer

(57) ABSTRACT

The present disclosure discloses, an evaporator assembly for a vertical flow type ice-making machine. The assembly comprising a plurality of tubes for circulating a refrigerant, and a plurality of conductive protrusions thermally coupled to and extending the plurality of tubes. Each of the plurality of conductive protrusions defines an ice-making region. The assembly also includes a non-conductive plate arranged adjacent to the plurality of tubes. The non-conductive plate is defined with a provision to accommodate the plurality of conductive protrusions which exchanges heat with the refrigerant flowing through the plurality of tubes and forms the ice layer by layer, and shape of at least one surface of the ice is defined by the non-conductive plate. The configuration of the assembly produces ice in the form of individual ice-cubes of a specific shape and size, and thereby improves the efficiency of the machine and ice-making process.

14 Claims, 20 Drawing Sheets

(52) U.S. Cl.
CPC ..... *F25C 2400/02* (2013.01); *F25C 2400/04* (2013.01); *F25C 2400/14* (2013.01)

(58) Field of Classification Search
CPC ..... F25C 2400/14; F25C 1/06; F25C 1/08; F25C 1/22
See application file for complete search history.

(56) References Cited

U.S. PATENT DOCUMENTS

| | | | | |
|---|---|---|---|---|
| 6,247,318 | B1 | 6/2001 | Stensrud et al. | |
| 7,281,385 | B2 | 10/2007 | Wakatsuki | |
| 8,677,774 | B2 | 3/2014 | Yamaguchi et al. | |
| 2006/0032263 | A1 | 2/2006 | Sanuki et al. | |
| 2006/0191281 | A1* | 8/2006 | Feldman | F25B 39/02 62/340 |
| 2006/0288725 | A1* | 12/2006 | Schlosser | F28F 1/022 62/347 |
| 2011/0005253 | A1 | 1/2011 | Yamaguchi et al. | |
| 2011/0005263 | A1 | 1/2011 | Yamaguchi et al. | |
| 2021/0199363 | A1 | 7/2021 | Sharma | |

FOREIGN PATENT DOCUMENTS

| | | | |
|---|---|---|---|
| CN | 104246398 | A | 12/2014 |
| CN | 104422220 | A | 3/2015 |
| DE | 1156092 | | 10/1963 |
| JP | 2009264729 | A | 11/2009 |
| JP | 2011196652 | A | 10/2011 |

OTHER PUBLICATIONS

Chinese Application No. 201880067077.7, Office Action dated Mar. 3, 2021, with partial English translation.

Indian Application No. 201711042696, Examination Report dated Mar. 9, 2021.

U.S. Appl. No. 17/263,105, filed Jan. 25, 2021, with USPTO Electronic Acknowledgement Receipt, specification and drawings (54 pages).

International Application No. PCT/IB2018/059331, International Search Report and Written Opinion dated Mar. 27, 2019.

* cited by examiner

EVAPORATOR ASSEMBLY FOR A VERTICAL FLOW TYPE ICE MAKING MACHINE

CROSS-REFERENCE TO RELATED APPLICATIONS

This application is a U.S. national stage filing under 35 U.S.C. § 371 of International Application No. PCT/IB2018/059331, entitled "AN EVAPORATOR ASSEMBLY FOR A VERTICAL FLOW TYPE ICE MAKING MACHINE," filed Nov. 27, 2018, which claims priority to Indian Application No. 201711042696, entitled "AN EVAPORATOR FOR A VERTICAL FLOW TYPE ICE MAKING MACHINE," filed Nov. 28, 2017, both of which are incorporated herein by reference in their entirety for all purposes.

TECHNICAL FIELD

Present disclosure in general relates to a field of refrigeration. Particularly but not exclusively, the disclosure relates to an ice making machine. Further, embodiments of the present disclose an evaporator assembly for a vertical flow type ice making machine which produces individual ice cubes.

BACKGROUND

Ice in form of blocks or cubes are used in number of different industries including but not limiting to food or beverage industries, storage industries, and the like. The ice used in various applications demand for different requirements. For example, ice used in storage sector is required to be in the form of lumps and bulky like blocks to store the food/perishable items for longer duration. On the other hand, the ice required for use in the food and service industries such as restaurants, beverage junctions, bars and pubs are required to be in smaller sizes like cubes for human consumption. Also, shape and size of the ice-cubes act as decorative item for customer attraction in the food and service industries.

Conventionally, different types of ice making machines are developed to produce ice in the form of blocks or cubes for use in different industries. Such conventional ice making machines are classified based on their working, and such classification may include batch type icemaking machines and flow type ice making machines.

The flow types ice making machines are the type of ice-making machines which produce the ice by continuously supplying refrigerant through an evaporator to cool the surface, and liquid on the other side to produce the ice. Currently the flow type ice-making machines having vertically mounted evaporator in the form of a big slab of ice. Individual ice cubes may have to be separated manually from the big slab of ice. However, the ice cubes so obtained by manual process may not be big or symmetrical, which may not be desirable. In addition, the evaporators of these flow type machines are known to be big and tall, making the design complex. Thus, the conventional flow type ice making machines and process may be slow and inefficient at forming ice. Also, harvesting of the ice from the conventional flow type ice making machines involves a tedious process, and is time consuming.

With the advancements in the technology, some of the flow type ice making machines which may produce individual ice cubes are developed. One such conventional vertical flow type ice making machine which produces individual ice cubes is disclosed in U.S. Pat. No. 8,677,774 B2. The ice making portions of an ice making machine have a pair of ice making plates disposed vertically and an evaporation tube disposed between back faces of the ice making plates. A plurality of vertically extending projected rims are formed at predetermined intervals widthwise on a surface of each ice making plate to define a plurality of ice making regions. The ice making plates facing the ice making regions are provided with consecutive vertical steps of inclined portions inclined from a back side towards a front side as directed downwardly, and contact horizontal extensions of the evaporation tube at a vertically intermediate position on a back face of each inclined portion.

In the conventional flow type ice making machine the ice cubes may directly formed on the surface of the plate which is cooled by coolant flowing through the tubes. However, this requires more power to operate the system since the entire plate is to be cooled, and reduces the thermal efficiency of the machine. Also, the conventional ice making machines are bulky and occupies lot of space.

The present disclosure is directed to over-come one or more problems stated above, and any other problem associated with the prior arts.

SUMMARY OF THE DISCLOSURE

One or more shortcomings of the prior art are overcome by an assembly as claimed and additional advantages are provided through the provision of assembly as claimed in the present disclosure. Additional features and advantages are realized through the techniques of the present disclosure. Other embodiments and aspects of the disclosure are described in detail herein and are considered a part of the claimed disclosure.

In a non-limiting embodiment of the disclosure, an evaporator assembly for a vertical flow type ice-making machine is disclosed. The assembly comprising a plurality of tubes for circulating a refrigerant, and a plurality of conductive protrusions thermally coupled to and extending from each of the plurality of tubes. Each of the plurality of conductive protrusions defines an ice-making region. The assembly also includes a non-conductive plate arranged adjacent to the plurality of tubes. The non-conductive plate is defined with a provision to accommodate each of the plurality of conductive protrusions which exchanges heat with the refrigerant flowing through the plurality of tubes and forms the ice layer by layer, and shape of at least one surface of the ice is defined by the non-conductive plate.

In an embodiment, thermal conductivity of a material of the plurality of conductive protrusions is higher than the thermal conductivity of the material of the non-conductive plate.

In an embodiment, each of the plurality of conductive protrusions extends downwardly from a corresponding tube of the plurality of tubes. The plurality of conductive protrusions extending from each of the plurality of tubes defines an array.

In an embodiment, the non-conductive plate defines a plurality of Zig-Zag pattern from one end to another end. Each of the plurality of Zig-Zag patterns is defined by a horizontally extending top and bottom surfaces, and an inclined surface interconnecting the horizontally extending top and bottom surfaces. The horizontally extending bottom surface of one zig-zag pattern of the plurality of zig-zag patterns act as the horizontally extending top surface of an adjacent zig-zag pattern of the plurality of zig-zag patterns.

In an embodiment, an array of conductive protrusions extending from each of the plurality of tubes is inclined at an angle to an inclined surface of a corresponding zig-zag pattern of the non-conductive plate, such that, each of the plurality of conductive protrusions is perpendicular to the inclined surface of the non-conductive plate.

In an embodiment, the plurality of tubes and the plurality of conductive protrusions are made of material selected from at least one of copper and aluminium or any other conductive material. The non-conductive plate is made of at least one of polymeric material and metallic material with low thermal conductivity when compared to material of the plurality of tubes and the plurality of conductive protrusions.

In an embodiment, the assembly comprises a plurality of guide channels extending from the horizontally extending top surface of a first zig-zag pattern of the plurality of zig-zag patterns for channelizing the liquid onto the plurality of conductive protrusions. Each of plurality of guide channels is defined with a curved guide path.

In another non-limiting embodiment, a vertical flow type ice-making machine is disclosed. The machine comprising one or more evaporator assemblies. Each of the one or more evaporator assembly comprising a plurality of tubes for circulating a refrigerant, and a plurality of conductive protrusions thermally coupled to and extending from each of the plurality of tubes. Each of the plurality of conductive protrusions defines an ice-making region. The assembly further includes a non-conductive plate arranged adjacent to the plurality of tubes. The non-conductive plate is defined with a provision to accommodate each of the plurality of conductive protrusions. The machine also comprises at least one liquid flowing channel positioned upstream side of each of the one or more evaporator assemblies for supplying liquid onto the plurality of conductive protrusions. The plurality of conductive protrusions exchanges heat with the refrigerant flowing through the plurality of tubes and forms the ice layer by layer, and shape of at least one surface of the ice is defined by the non-conductive plate.

In an embodiment, the machine comprises at least defrost liquid flow channel positioned in upstream side of the plurality of tubes for selectively supplying fresh fluid onto the plurality of tubes.

In an embodiment, the non-conductive plate is defined with a narrow opening in the other end.

In an embodiment, the machine also comprises an actuator mechanism coupled to the one or more evaporator assemblies, wherein, the actuator mechanism selectively operates each of the one or more evaporator assemblies between a first position and a second position. The first position corresponds ice forming position, and the second position corresponds to harvest position.

It is to be understood that the aspects and embodiments of the disclosure described above may be used in any combination with each other. Several of the aspects and embodiments may be combined together to form a further embodiment of the disclosure.

The foregoing summary is illustrative only and is not intended to be in any way limiting. In addition to the illustrative aspects, embodiments, and features described above, further aspects, embodiments, and features will become apparent by reference to the drawings and the following detailed description.

BRIEF DESCRIPTION OF THE ACCOMPANYING FIGURES

The novel features and characteristics of the disclosure are explained herein. The embodiments of the disclosure itself, however, as well as a preferred mode of use, further objectives and advantages thereof, will best be understood by reference to the following description of an illustrative embodiment when read in conjunction with the accompanying drawings. One or more embodiments are now described, by way of example only, with reference to the accompanying drawing in which:

FIGS. 1*a* and 1*b* illustrates a perspective view and side view of an evaporator assembly for vertical flow type ice-making machine with finger type ice-making protrusions in one side, according to an embodiment of the present disclosure.

FIG. 2 illustrates the evaporator of FIG. 1*b* in ice forming and harvest cycles.

FIGS. 3*a* and 3*b* illustrates a perspective view and side view of an evaporator assembly of FIGS. 1*a* and *b* with ice-making portion in both the sides, according to an embodiment of the present disclosure.

FIG. 4 illustrates the evaporator of FIG. 3*b* in ice forming and harvest cycles.

FIGS. 5*a* and 5*b* illustrates schematic side views of ice-making machine employed with the evaporator assembly of FIG. 1*a* in first and second tilting position respectively, according to an exemplary embodiment of the disclosure.

FIG. 5*c* illustrates schematic perspective view of the icemaking machine of FIG. 5*a*, showing guide channels.

FIGS. 6*a* and 6*b* illustrate different views of the ice machine of FIG. 5*a* with integrated ice storage bin, according to an embodiment of the disclosure.

FIGS. 7*a* and 7*b* illustrates a perspective view and side view of an evaporator assembly for vertical flow type ice-making machine with U-shaped ice-making protrusions on both the sides, according to an embodiment of the present disclosure.

Figure 7A:
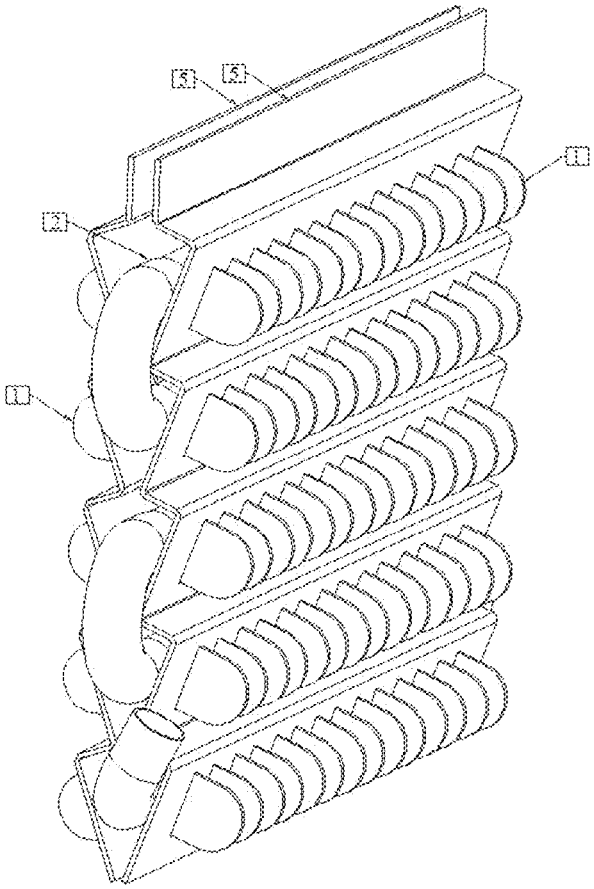
Figure 7B:
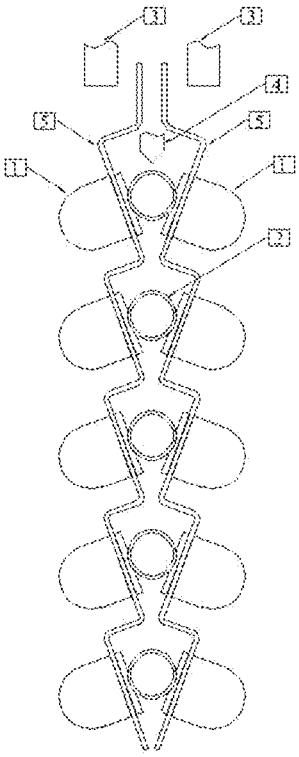
Figure 10A:
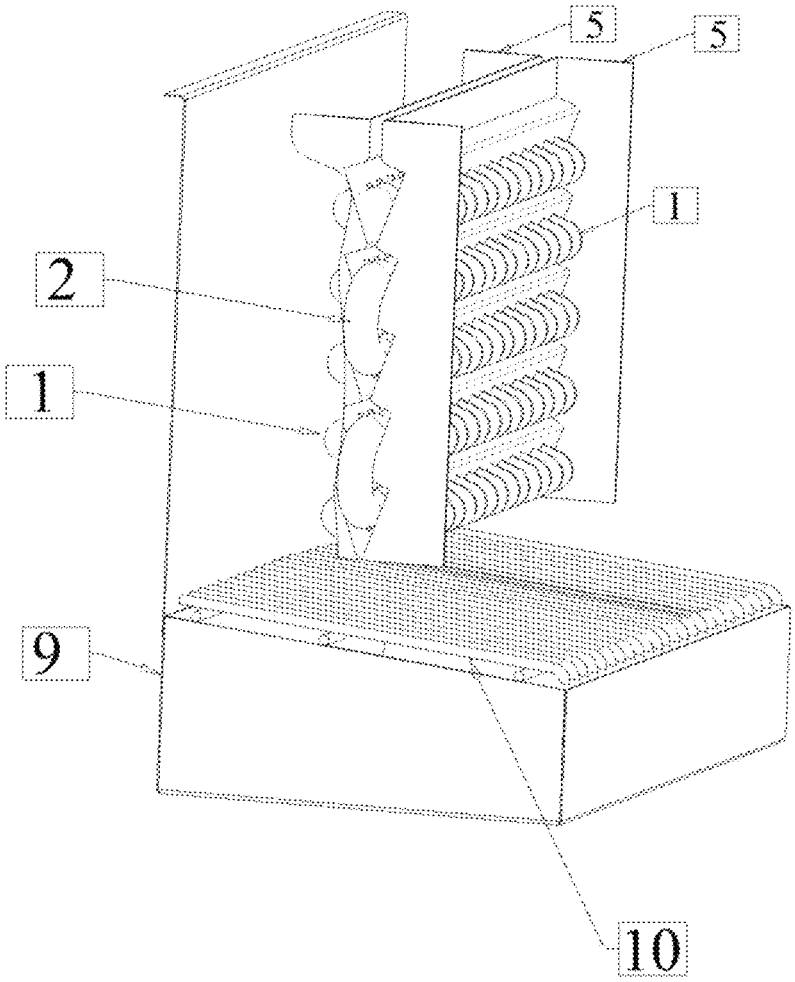
Figure 10B:
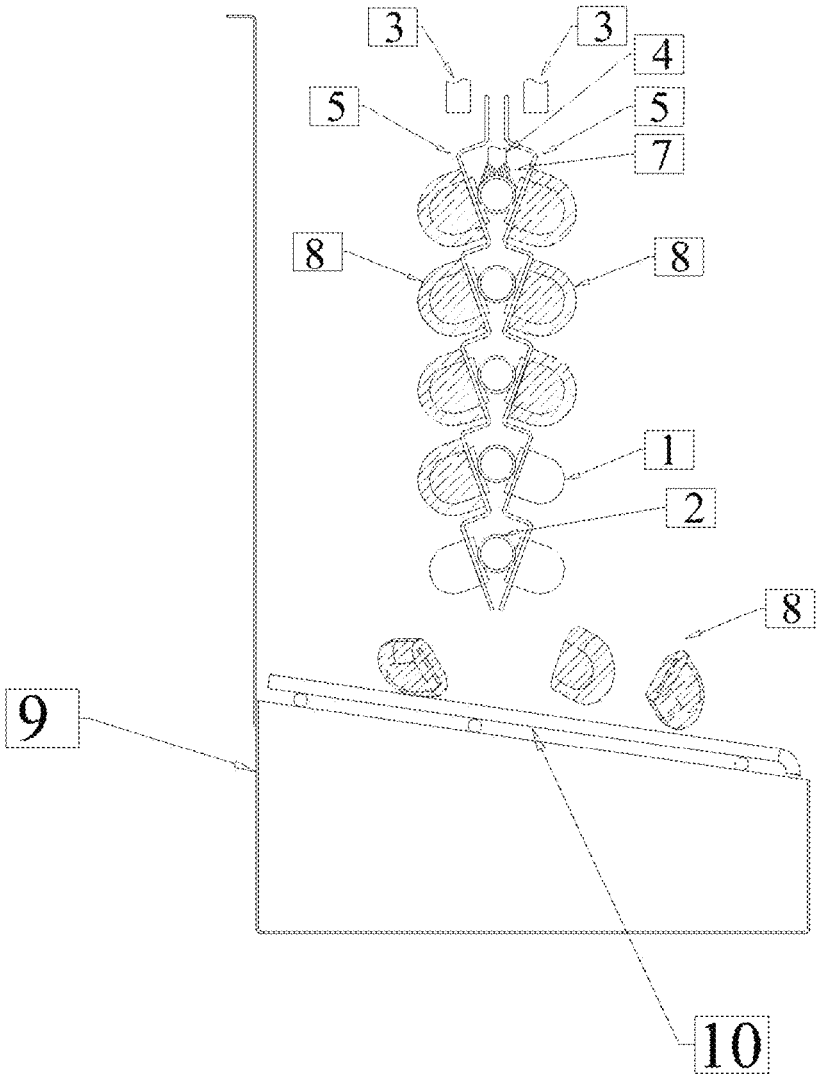

FIGS. 10*a* and 10*b* illustrates schematic perspective view and side view of ice-making machine employed with the evaporator assembly of FIG. 7*a*, according to an exemplary embodiment of the disclosure.

Figure 11A:
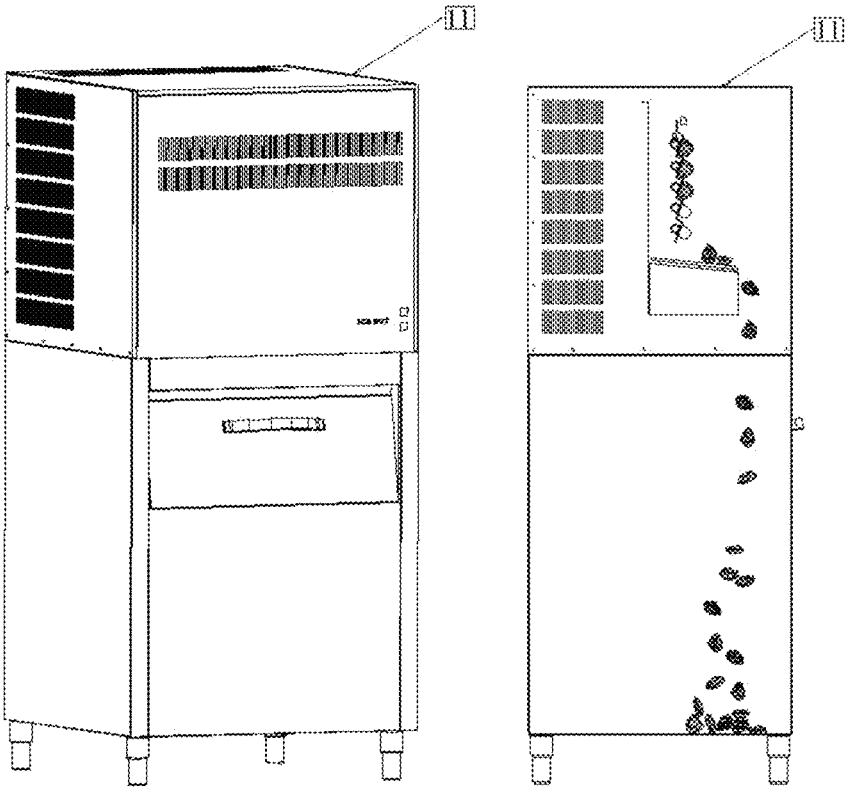
Figure 11B:
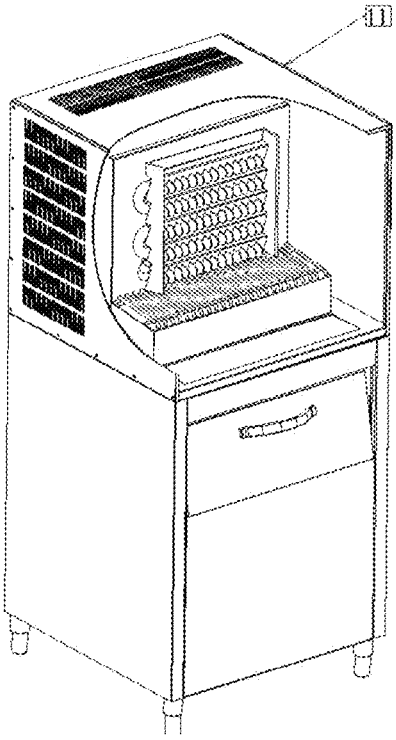

FIGS. 11*a* and 11*b* shows different views of the ice machine of FIG. 10*a* with integrated ice storage bin, according to an embodiment of the disclosure.

Figure 12A:
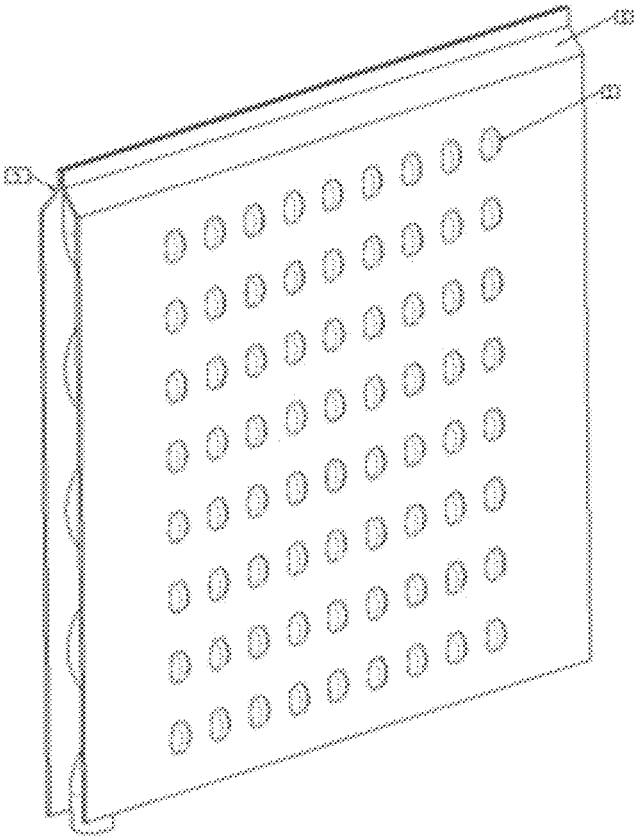
Figure 12B:
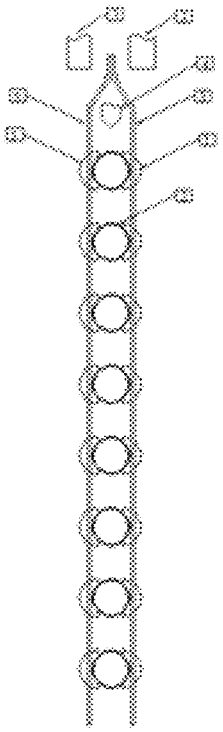

FIGS. 12*a* and 12*b* illustrates a perspective view and side view of an evaporator assembly for vertical flow type ice-making machine with Hemi spherical-shaped ice-making protrusions on both the sides, according to an embodiment of the present disclosure.

Figure 13:
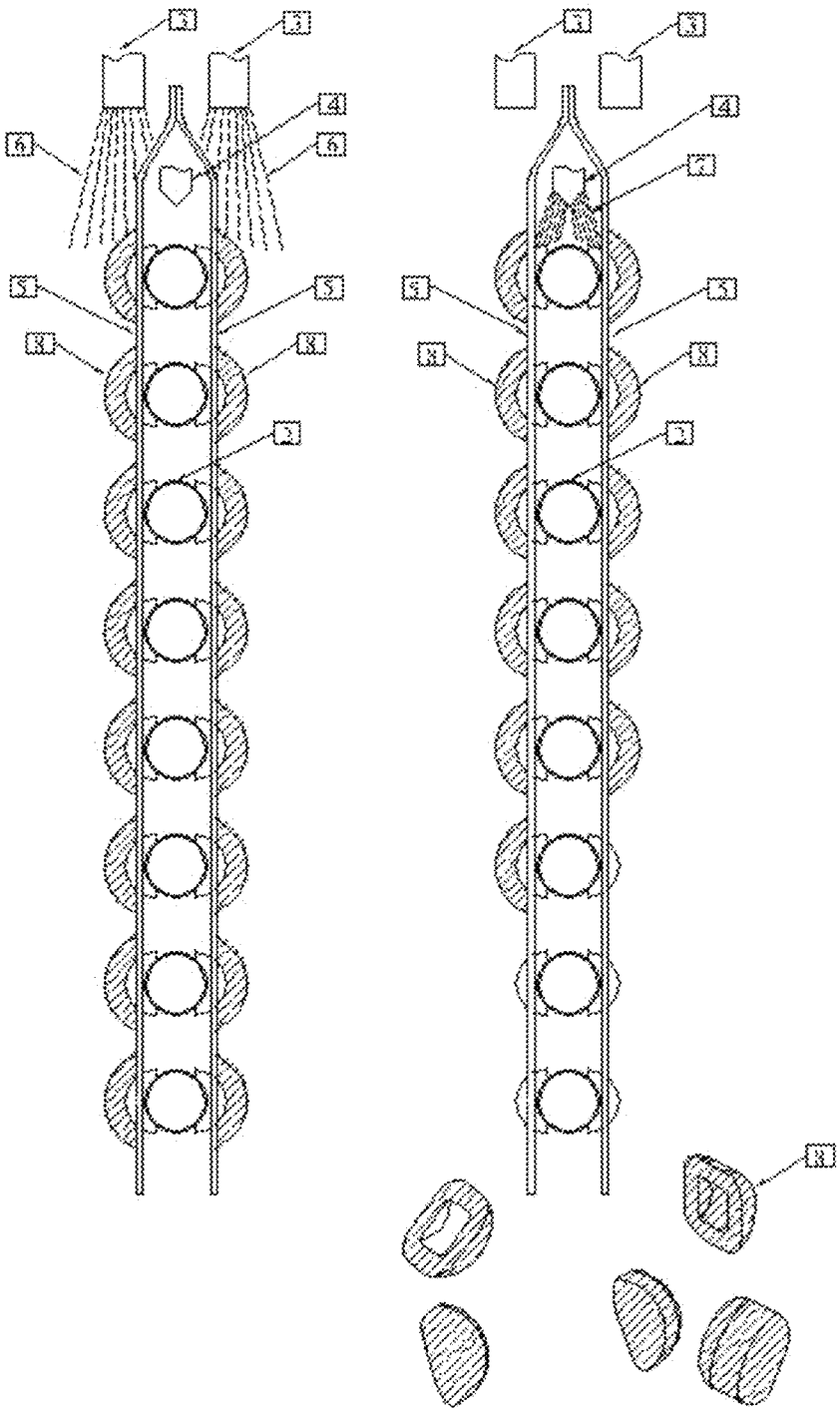

FIG. 13 illustrates the evaporator assembly of FIG. 12*b* in ice forming and harvest cycles.

Figure 14A:
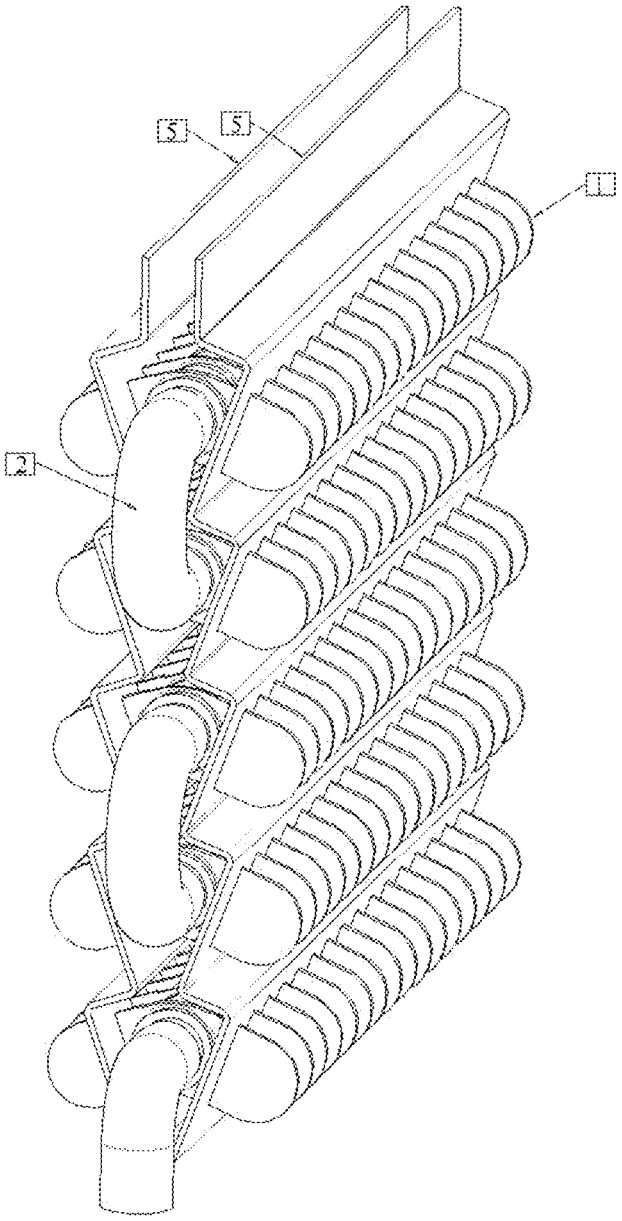
Figure 14B:
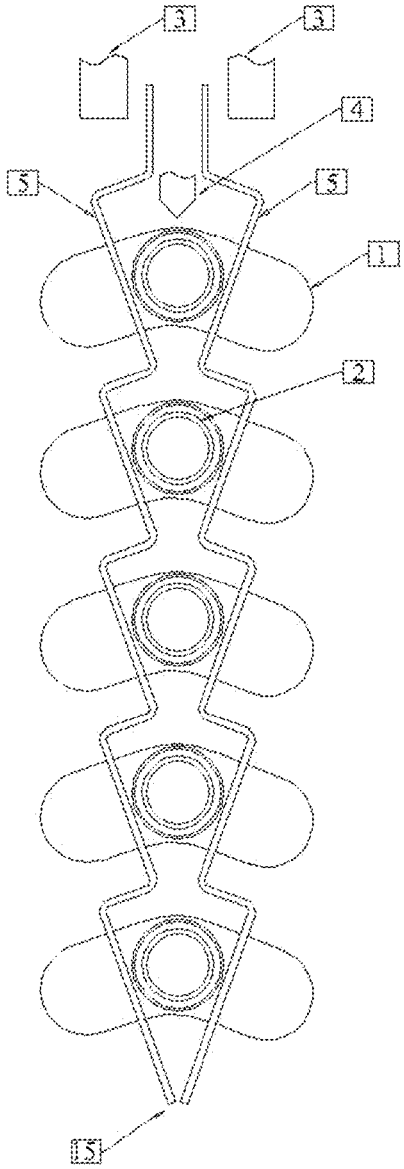

FIGS. 14*a* and 14*b* illustrates a perspective view and side view of an evaporator assembly for vertical flow type ice-making machine with U-shaped ice-making protrusions on both the sides, with large contact area according to an embodiment of the present disclosure.

Figure 14C:
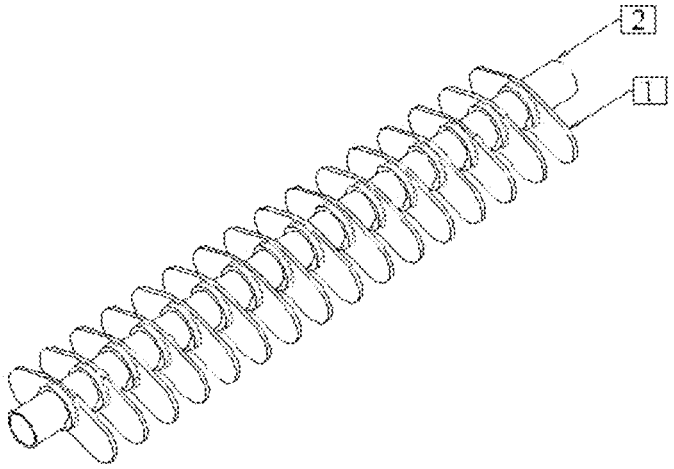
Figure 14D:
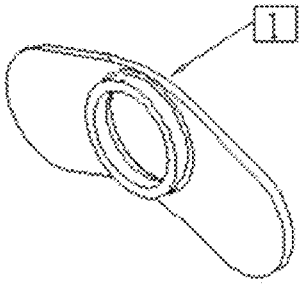

FIGS. 14*c* and 14*d* illustrates perspective view of a tube with an array of conductive protrusions on both the sides with large surface area according to an embodiment of the present disclosure.

The figures depict embodiments of the disclosure for purposes of illustration only. One skilled 20 in the art will readily recognize from the following description that alternative embodiments of the structures and methods illustrated herein may be employed without departing from the principles of the disclosure described herein.

DETAILED DESCRIPTION

The foregoing has broadly outlined the features and technical advantages of the present disclosure in order that the detailed description of the disclosure that follows may be better understood. Additional features and advantages of the disclosure will be described hereinafter which form the subject of the claims of the disclosure. It should be appreciated by those skilled 30 in the art that the conception and specific embodiment disclosed may be readily utilized as a basis for modifying or designing other mechanism for carrying out the same purposes of the present disclosure. It should also be realized by those skilled in the art that such equivalent constructions do not depart from the scope of the disclosure as set forth in the appended claims. The novel features which are believed to be characteristic of the disclosure, both as to its organization and method of operation, together with further objects and advantages will be better understood from the following description when considered in connection with the accompanying figures. It is to be expressly understood, however, that each of the figures is provided for the purpose of illustration and description only and is not intended as a definition of the limits of the present disclosure.

Embodiments of the disclosure disclose an evaporator assembly for a vertical flow type ice-making machine. The evaporator assembly of the conventional vertical flow machines produce the ice in the form blocks, and the block of ice may have to be manually harvested/cut into pieces for use in various applications. The evaporator assembly of the present disclosure, may be configured to produce ice-cubes of specific shapes and configurations in a flow type ice-making machine, thus eliminates the need for manually separating the ice cubes, and thereby improves the ice-making process.

Accordingly, the evaporator assembly for the vertical flow type ice-making machine comprises a plurality of tubes for circulating a refrigerant, and a non-conductive plate arranged adjacent to the plurality of tubes. The evaporator assembly further includes a plurality of conductive protrusions arranged in array. Each of the plurality of conductive protrusions are thermally coupled to the plurality of tubes, and extends downwards on the non-conductive plate. Each of the plurality of conductive of protrusions defines ice-making regions in the ice-making machine. When, the refrigerant passes through the plurality of tubes, the plurality of conductive protrusions will be cooled, and when the liquid passes on the plurality of conductive protrusions ice may be formed layer by layer. The shape of plurality of conductive protrusions may be selected based on shape of the ice-cubes to be produced. The ice is formed over these protrusions gives small as well as big and beautiful individual ice cubes.

The terms "comprises", "comprising", or any other variations thereof, are intended to cover a non-exclusive inclusion, such that an assembly, device or method that comprises a list of components or steps does not include only those components or steps but may include other components or steps not expressly listed or inherent to such setup or device or method. In other words, one or more elements in a system or apparatus proceeded by "comprises . . . a" does not, without more constraints, preclude the existence of other elements or additional elements in the system or apparatus.

In the following description, the words such as upper, lower, front and rear are referred with respect to particular orientation of the assembly as illustrated in drawings of the present disclosure. The words are used to explain the aspects of the present disclosure and for better understanding. However, one should not construe such terms as limitation to the present disclosure, since the terms may interchange based on the orientation of the assembly. Further, in the description, the word substantially refers to a position which may be near to or at the location indicated. For example, substantially upper portion may refer to upper portion or slightly below the upper portion, similarly substantially lower portion may refer to lower portion of slightly above the lower portion.

It should be appreciated that the term "liquid" is used throughout the specification to describe the substance distributed in machine and used to make ice.

In some embodiments, the liquid is water or at least has a high percentage of water content (thus, the liquid will act substantially as water would under the same conditions). It should be noted that the term "non-conductive plate" referred throughout the specification is member which may be made of less conductive material when compared to the projections. In other words, the conductivity of the non-conductive plate is very poor when compared to the conductivity of the projections.

Reference will now be made to the exemplary embodiments of the disclosure, as illustrated in the accompanying drawings. Wherever possible, same numerals will be used to refer to the same or like parts. The following paragraphs describe the present disclosure with reference to FIGS. 1 to 14.

Figure 1A:
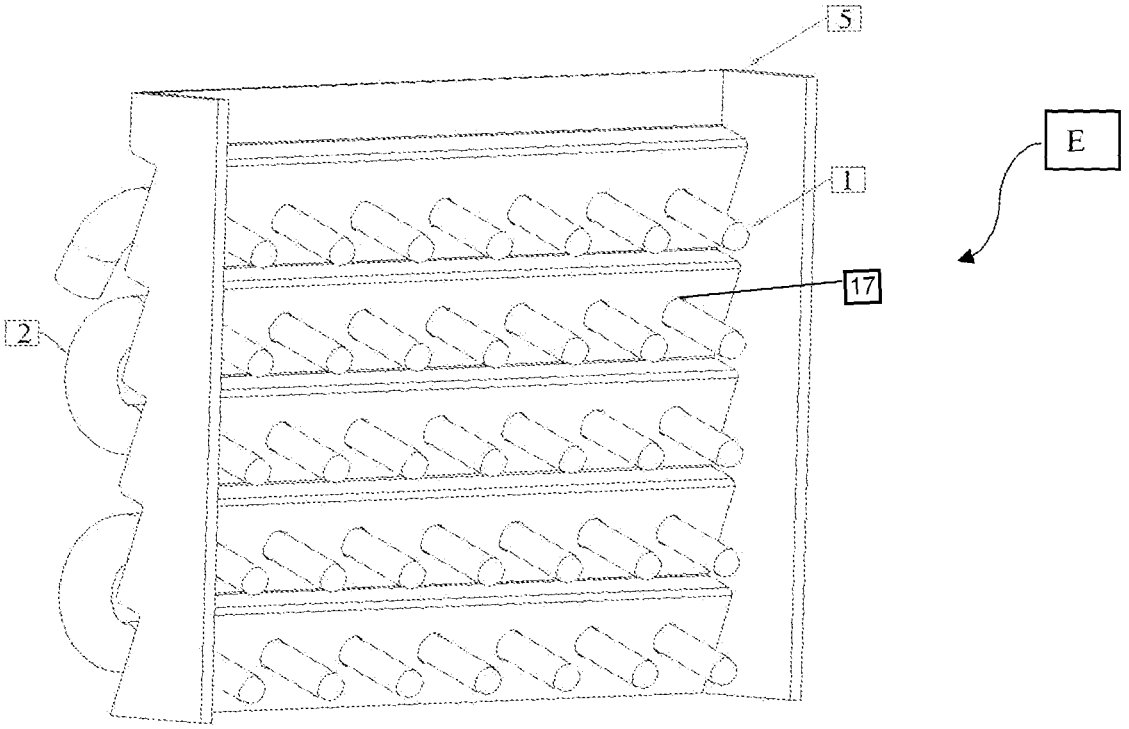
Figure 1B:
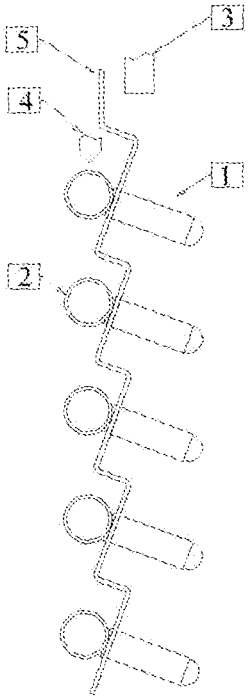

FIGS. 1*a* and 1*b* are exemplary embodiments of the disclosure illustrating perspective view and side view of the evaporator assembly (E) for a vertical flow type ice making machine. The evaporator assembly (E) includes a plurality of tubes (2) also referred as evaporation tubes for circulation of coolant such as but not limiting to refrigerant. The plurality of tubes (2) may fluidly connected to an expansion valve of refrigeration unit [not shown], and carries the coolant from the expansion valve. The coolant in the plurality of tubes (2) may exchange thermal energy with the surroundings and goes to a condenser, and the cycle continues. In an embodiment, the plurality of tubes (2) may be interconnected to one another, to circulate the refrigerant. In another embodiment, each of the plurality of tubes (2) may receive the refrigerant separately.

As shown in FIG. 1*b*, the plurality of tubes (2) are thermally coupled to a plurality of conductive protrusions (1). In an embodiment, as shown in FIG. 1*a* the plurality of conductive protrusions (1) is finger shaped protrusions and are made of thermally conductive material. Also, the plurality of conductive protrusions (1) may be made of same material as that of the plurality of tubes (2). As an example, the material used for plurality of conductive protrusions (1) and the plurality of tubes (2) may be any metallic material such as copper or aluminum. The plurality of conductive protrusions (1) may be arranged in one more arrays, and are extending downwardly from the plurality of tubes (2). Each of the plurality of conductive protrusions (1) may exchange heat with the plurality of tubes (2) and thereby define an icemaking region. The evaporator assembly (E) also includes a non-conductive plate (5) in between the plurality of protrusions (1) and the plurality of tubes (2).

The non-conductive plate (5) may be configured in a form of an enclosure, having a pair of vertical walls extending on either side of a plate, thereby separating an ice-making region from a coolant circulation region. The vertical walls define a boundary for circulation of liquid for a particular ice making region. The non-conductive plate (5) includes a plurality of provisions, e.g., apertures (17), each for accommodating at least one of the plurality of conductive protrusions (1). As shown in FIGS. 1*a* and 1*b*, the non-conductive plate (5) is in the form of a plurality of zig-zag patterns or stepped portions, such that each zig-zag pattern is inclined at an angle from one end to other end. In an embodiment, each of the plurality of Zig-Zag patterns is defined by a horizontally extending top and bottom surfaces (5*a* and 5*b*), and an inclined surface (5*c*) interconnecting the horizontally extending top and bottom surfaces (5*a* and 5*b*). The horizontally extending bottom surface (5*b*) of one zig-zag pattern of the plurality of zig-zag patterns act as the horizontally extending top surface (5*a*) of an adjacent zig-zag pattern of the plurality of zig-zag patterns.

The zig-zag pattern or stepped configuration of the non-conductive plate (5) facilitates tickling of liquid flowing on top surface to other regions, thereby facilitates formation of ice on the conductive protrusions (1) layer by layer. Further, the plurality of conductive protrusions (1) are arranged in the evaporator assembly (E) in a plurality of arrays, wherein each array includes a plurality of conductive protrusions (1). Each array of protrusions (1) are arranged in at least one step/zig-zag pattern of the non-conductive plate such that, conductive protrusions (1) extending from each of the plurality of tubes (2) is inclined at an angle to the inclined surface (5*c*) of a corresponding zig-zag pattern of the non-conductive plate (5), such that, each of the plurality of conductive protrusions (1) is perpendicular to the inclined surface (5*c*) of the non-conductive plate (5). This configuration facilitates the liquid flowing on top surface tickle to the other regions, thereby facilitates formation of ice on the protrusions (1) layer by layer.

In an embodiment of the disclosure, the non-conductive plate (5) may be made of a polymeric material, such as but not limiting to plastic or any other composite material. In another embodiment, the non-conductive plate (5) may be made of material which has less thermal conductivity than the material of conductive protrusions (1).

Figure 2:
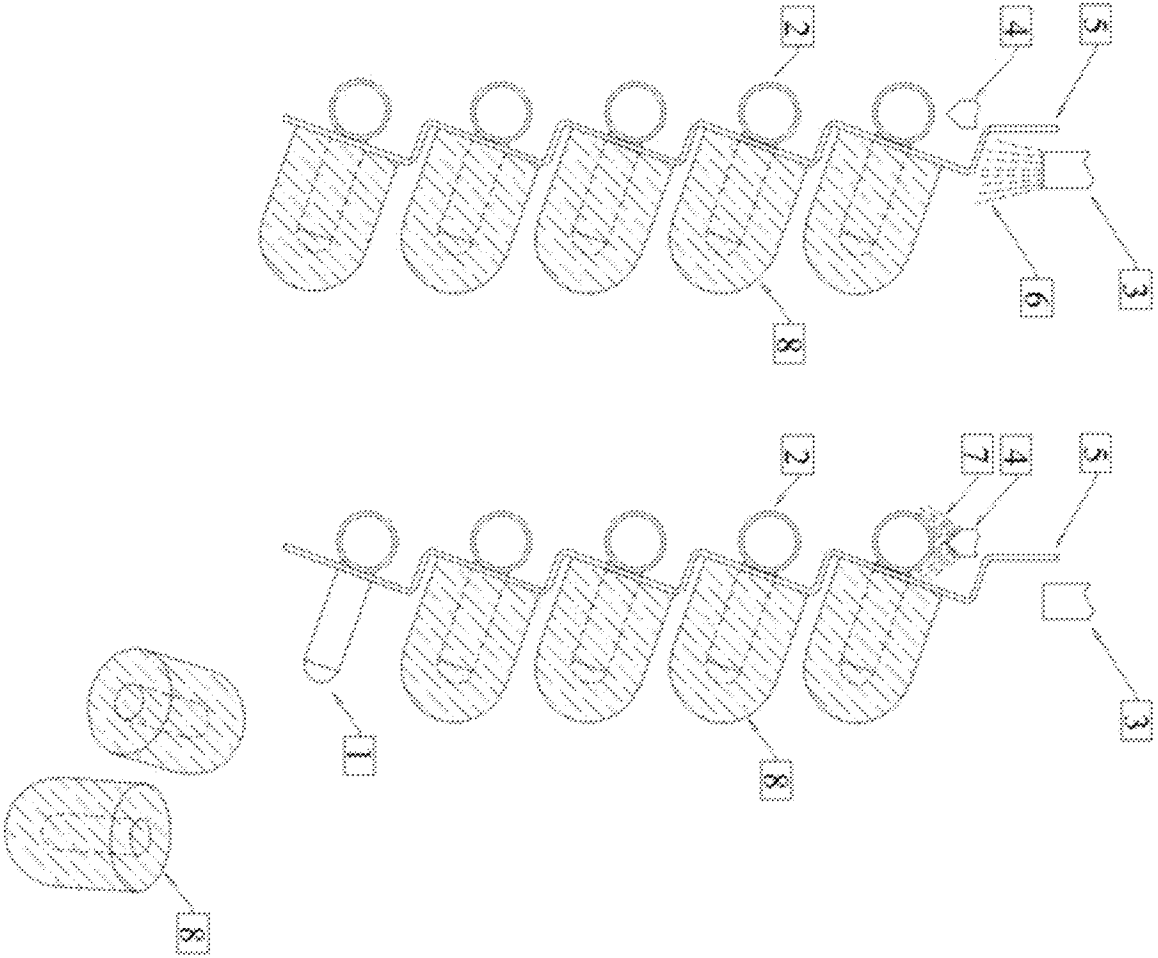

Referring to FIG. 2 the operation of the evaporator assembly (E) may be explained in two cycles—cooling cycle and harvest cycle.

During the operation of the evaporator assembly (E) in cooling cycle, the coolant will be circulated in the plurality of tubes (2) which cools down the plurality of conductive protrusions (1). At the same time, liquid (6) flows at the top of the non-conductive plate (5) through liquid flow channel (3) which flows on each of the plurality of conductive protrusions (1). As the liquid flows on to the array of conductive protrusions (1), ice may be formed on each of the conductive protrusions (1) layer by layer and the ice is allowed to build up to desired thickness. The zig-zag pattern of the non-conductive plate (5) facilitates easy flow of liquid and symmetrical shape of ice cubes may be formed around the protrusions (1). Here, the inclined surface (5*c*) of the zig-zag pattern defines at least a portion of surface of the ice cube.

Further, during the operation of the evaporator assembly (E) in harvest cycle, the ice cubes (8) formed along the array of protrusions (1) are to be retrieved. Once the desired thickness of ice is formed along the conductive protrusions (1), warm coolant may be allowed to flow through the plurality of tubes (2) which heats the protrusions (I) and causes the surrounding ice to melt. At the same time, defrost liquid (7) like warm water may be made to flow at the back of the non-conductive plate (5) through a defrost liquid flow channel (4). As a result, the defrost liquid (7) exchanges temperature with the non-conductive plate (5) which conducts heat from one surface to other surface, and thereby ice cubes (8) melts free of the non-conductive plate (5) which may separate from the conductive protrusion (1) through gravity due to inclination of the conductive protrusions (1).

Figure 3A:
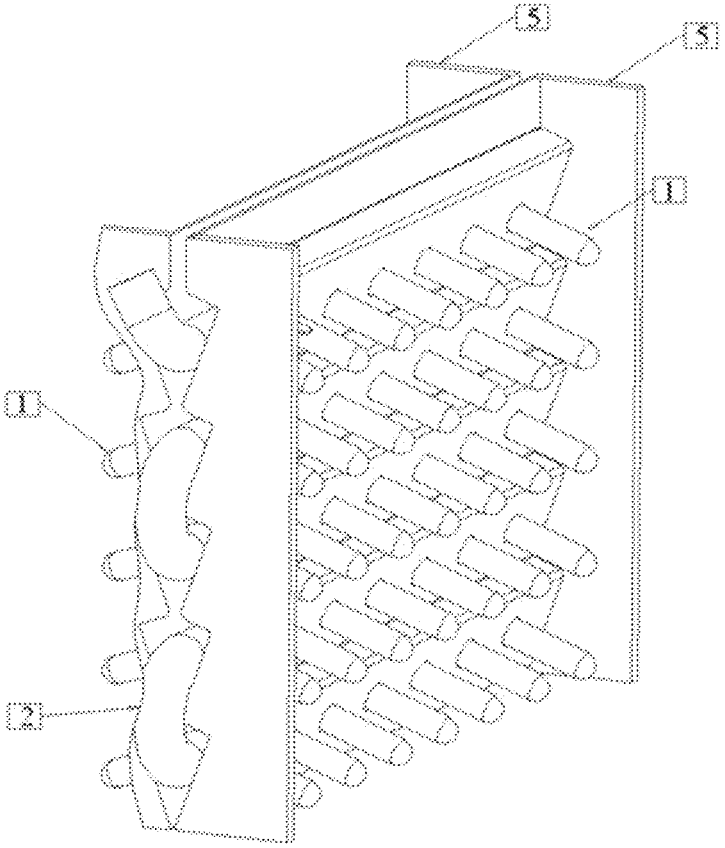
Figure 3B:
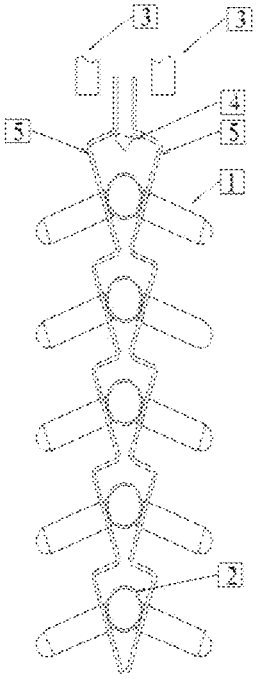
Figure 4:
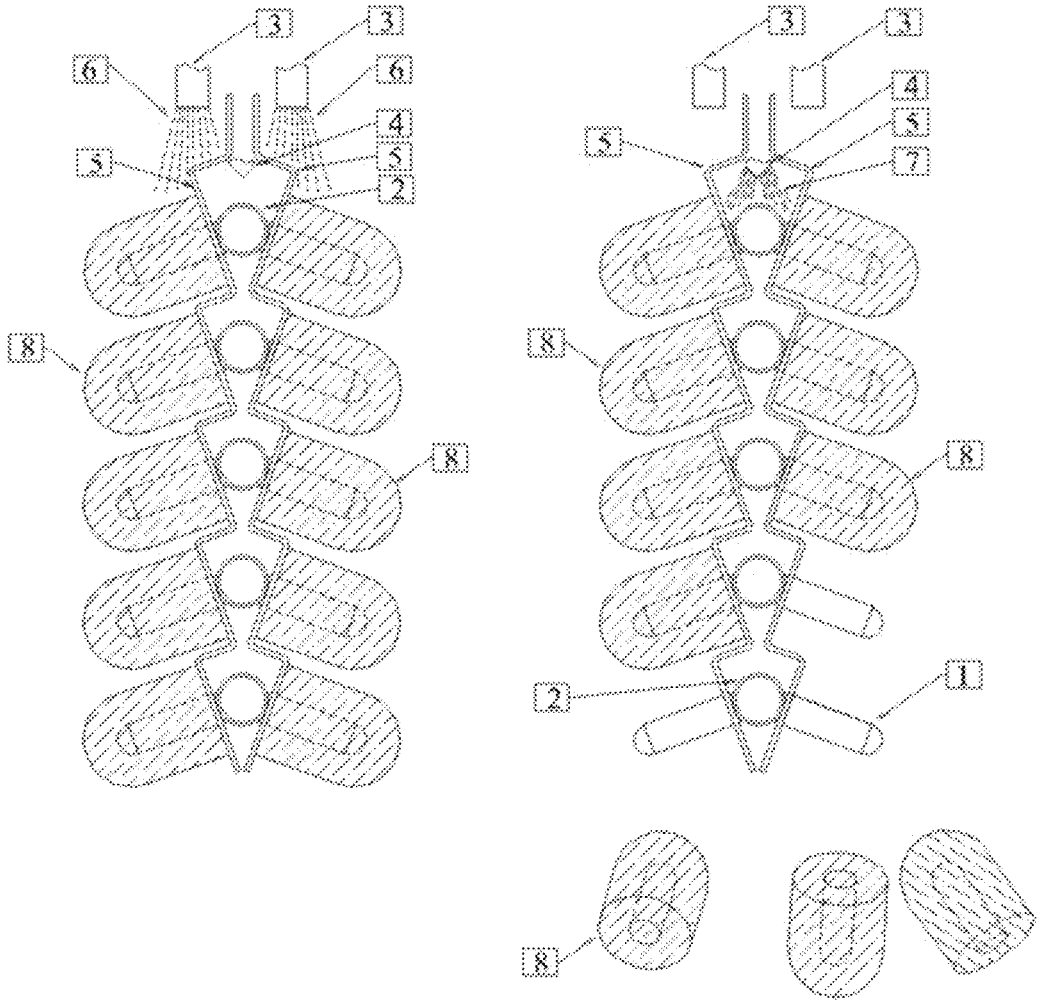

Now referring to FIGS. 3*a*, 3*b* and 4 which are exemplary embodiments of the disclosure illustrating perspective view and side view of the evaporator assembly (E) for a vertical flow type ice making machine (11). As shown in FIG. 3*a*, the evaporator assembly (E) may be configured with ice-making regions on both sides of the plurality of tubes (2). In this configuration, the evaporator assembly (E) may include two non-conductive plates (5). Each non-conductive plate (5) may include a pair of vertical walls extending on either side of a plate, thereby separating an ice-making region from a coolant circulation region. Further, a plurality of conductive protrusions (1) may be provided on either side of the plurality of tubes (2), and are thermally coupled to the plurality of tubes (2). Also, two liquid supplying channels (3) may be provided in the evaporator assembly (E) for supplying the liquid to the corresponding side during cooling/ice forming cycle. As shown in FIG. 4, the ice cubes (8) may be formed on both the sides of the evaporator assembly (E), by tickling of liquid from top surface to the other regions. Also, the ice cubes (8) may be harvested by supplying a warm coolant through the plurality of tubes (2), which heats the protrusions (1) and causes the surrounding ice to melt. At the same time, defrost liquid (7) like warm water may be made to flow at the back of the non-conductive plates (5) through a defrost liquid flow channel (4). As a result, the ice cubes (8) melts free of the respective non-conductive plate (5) which may separate from the respective conductive protrusion (1) due to gravity.

Figure 5A:
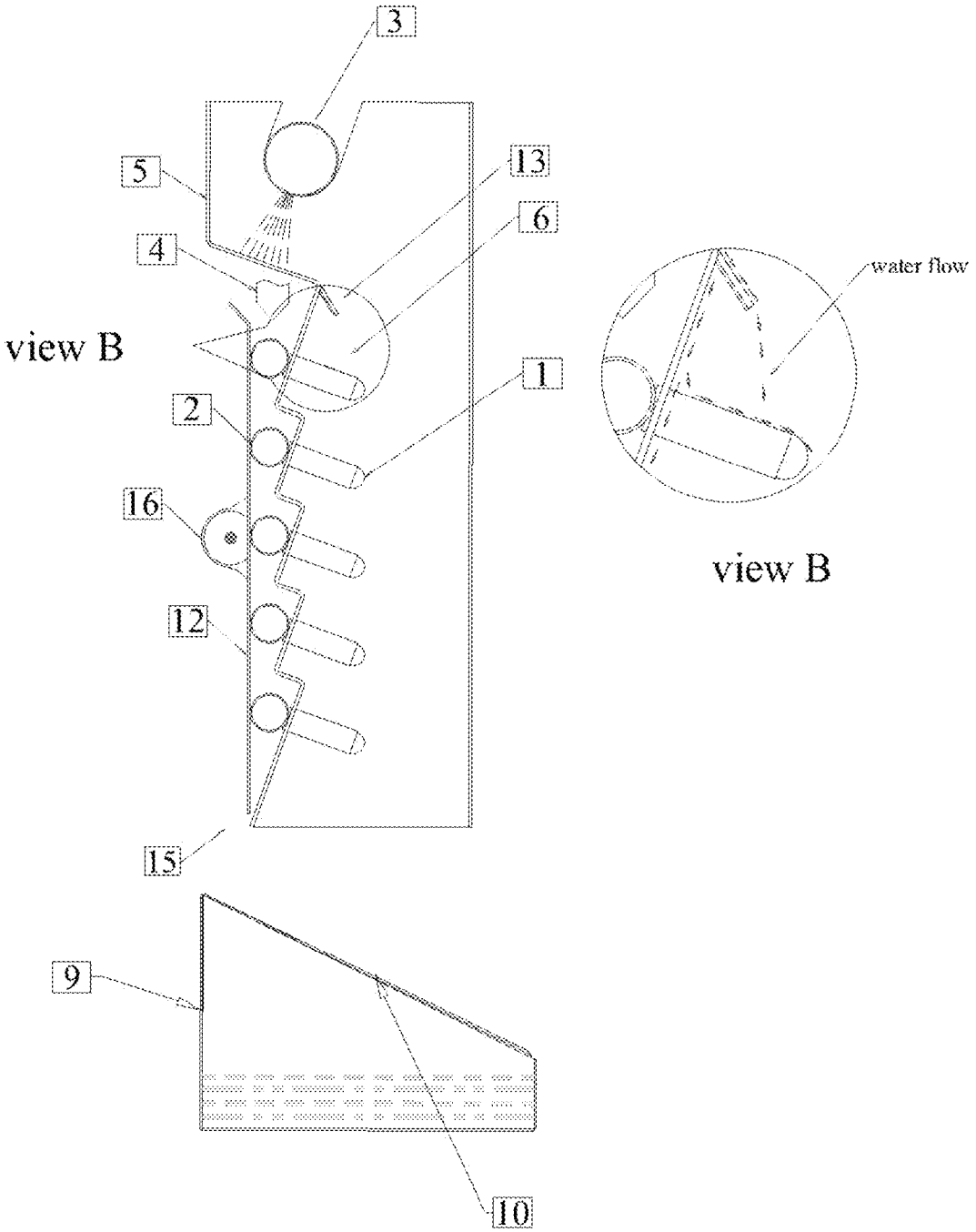
Figure 5B:
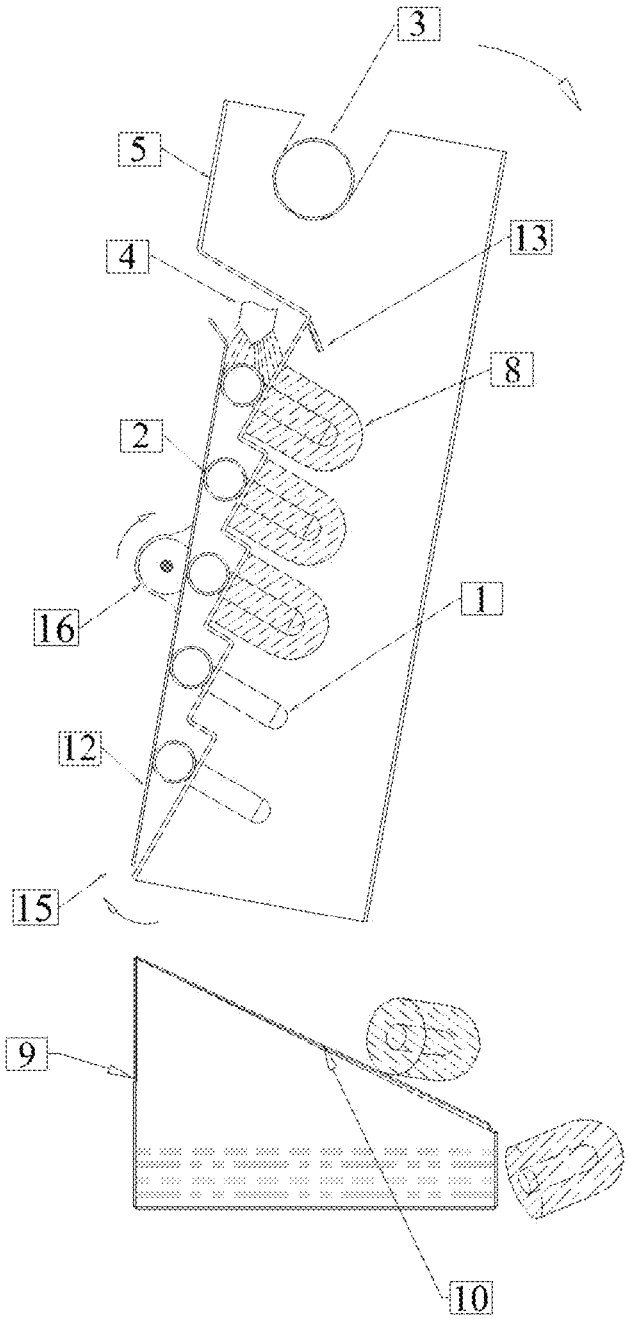
Figure 5C:
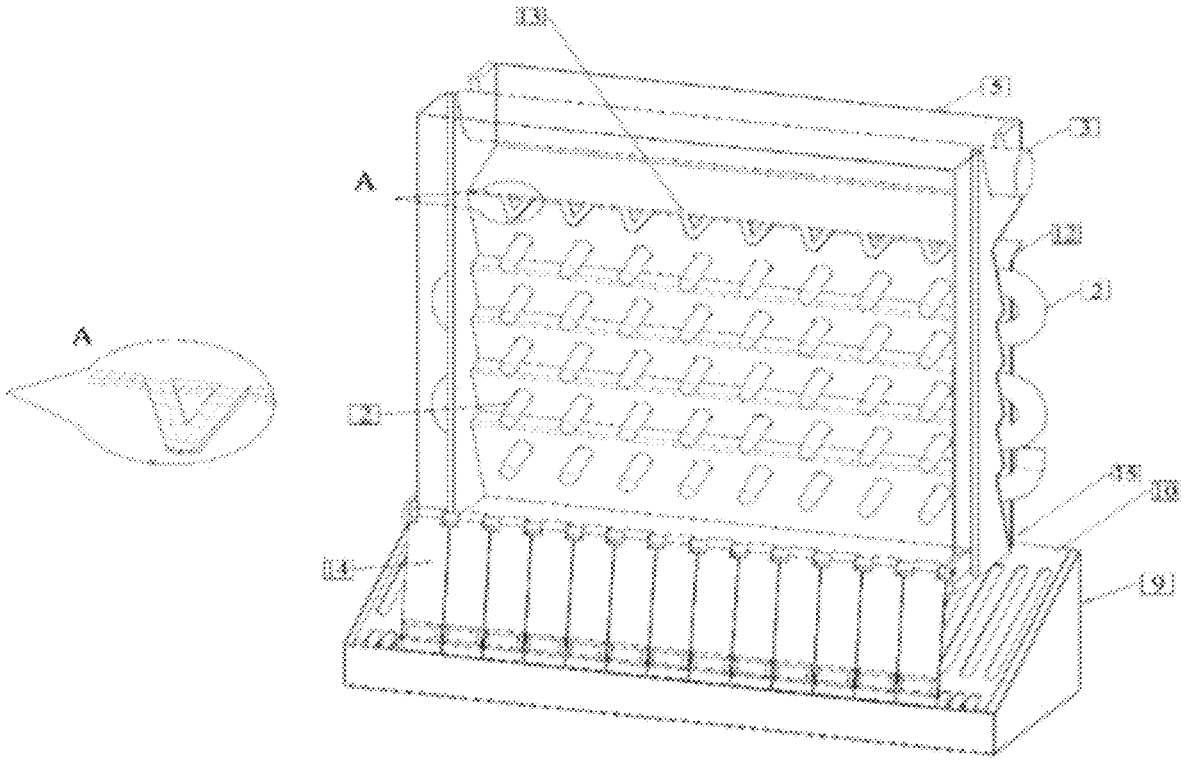
Figure 6A:
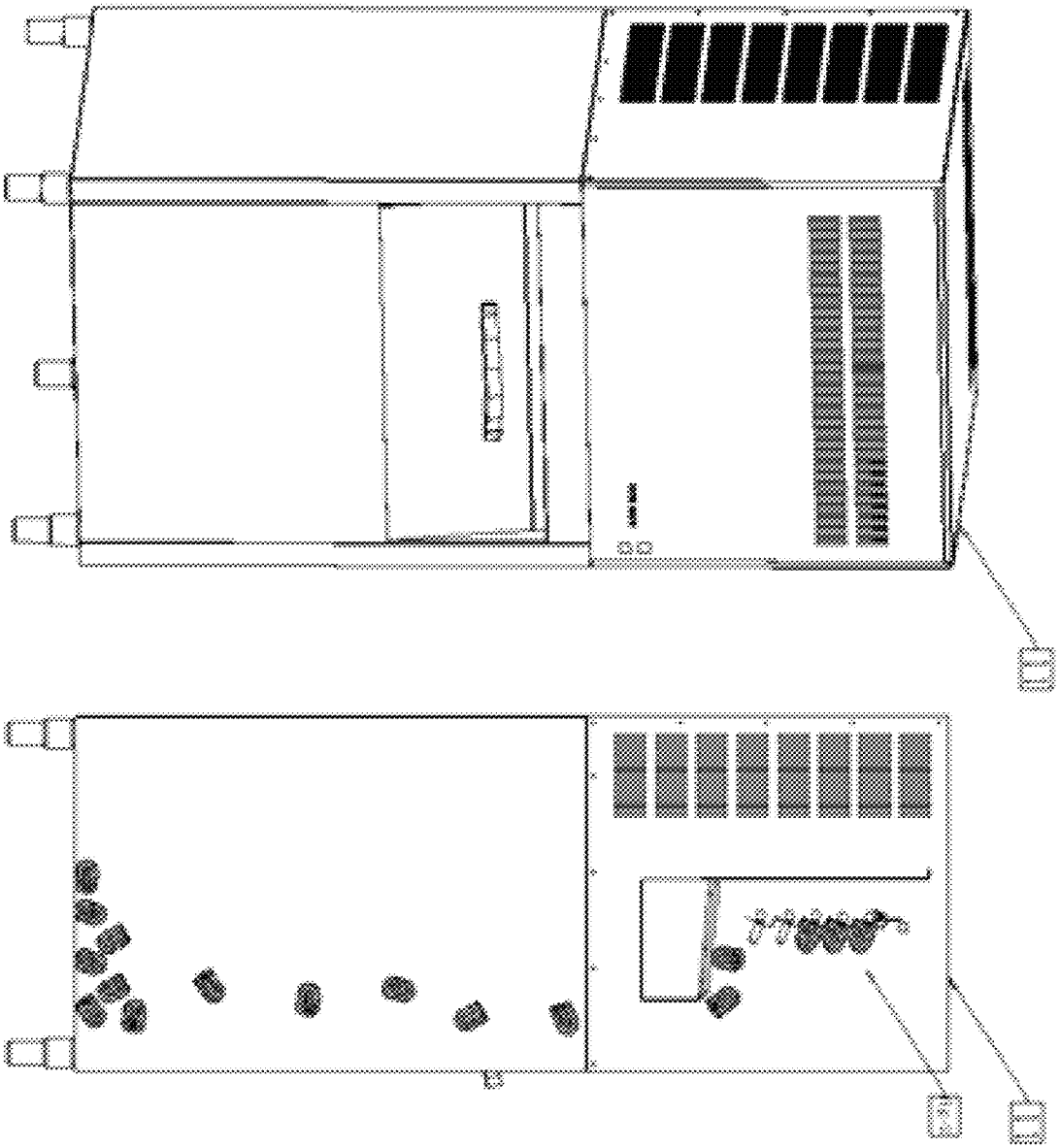
Figure 6B:
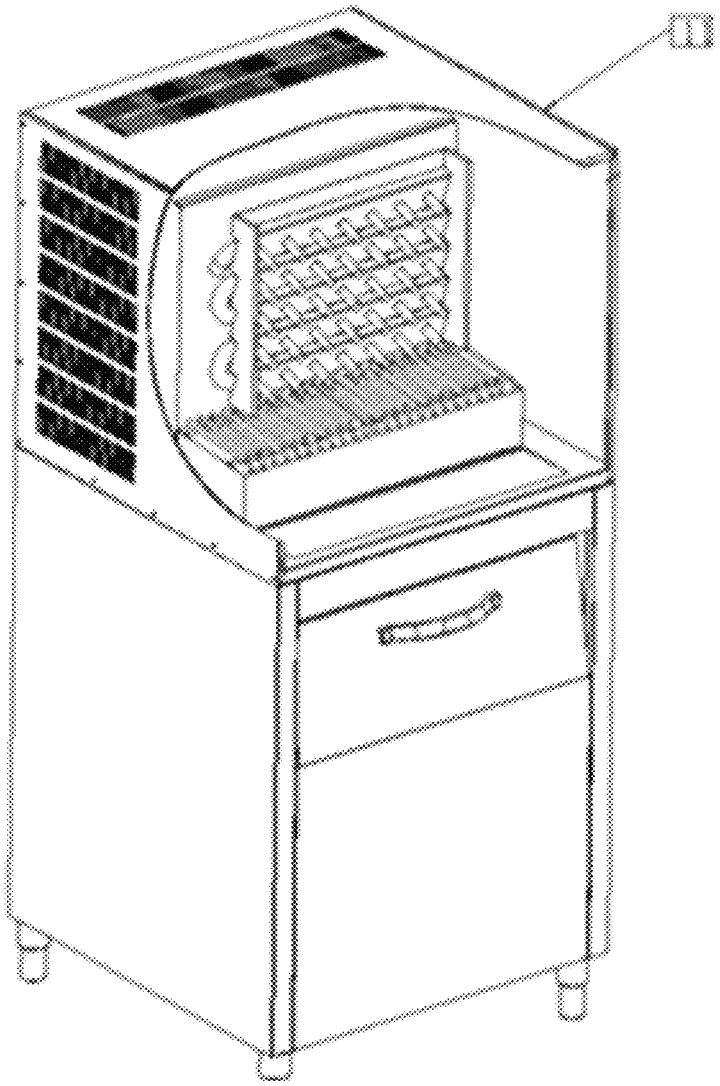

Reference is now made to FIGS. 5*a*-5*c* which are exemplary embodiments of the disclosure illustrating schematic side views and a perspective view of a vertical flow type ice making machine (11). As shown in FIG. 5*a* the icemaking machine (11) may include a liquid storage tank (9) for storing a liquid which is used making of ice. The liquid storage tank (9) may be of any capacity, and may depend on the number of evaporator assemblies (E) employed therein. The ice making machine (11) also includes one or more liquid flowing channels (3) in fluid communication with the liquid storage tank. The liquid flowing channels (3) may receive the liquid stored in the liquid storage tank (9) through a pump [not shown], and supply onto the plurality of conductive protrusions (1). Further, a top surface of the liquid storage tank (9) may be perforated such that the liquid tickling from the non-conductive plate may be collected in the liquid storage tank (5). Also, as shown in FIG. 5*b*, the ice making machine (11) may include an inclined plate (10) on the top surface of the liquid storage tank (9), such that the ice cubes separated from the plurality of protrusions (1) slides down from the ice making machine (11). The ice making machine (11) may also be provided with an enclosure to house the machine, and a storage bin integrated with the ice making machine (11) [shown in FIGS. 6*a*-6*b*]. In an embodiment, the storage bin is provided below the ice making machine (11) such that the ice cubes (8) sliding down from the evaporator assembly (E) may be collected and stored in the storage bin [as shown in FIG. 6*a*]. Referring again to FIGS. 5*a* and 5*c*, the ice making machine (11) includes a plurality of guide channels (13) [shown in details as (A)]. In an embodiment, the plurality of guide channels (13) are provided on a horizontally extending top surface (5*a*) of the first zig-zag pattern of the plurality of zig-zag patterns of each non-conductive plate (5). The plurality of guide channels (13) are defined with a curved profile to guide or channelize the liquid supplied on top surface of the non-conductive plate onto the plurality of conductive protrusions (1) [best shown in FIG. 5*a*]. In an exemplary embodiment, each of the plurality of guide channel (13) is in 'V' shape.

Further, referring to FIGS. 5*a* and 5*b* the ice making machine (11) is employed with pivot (16) and an actuator mechanism coupled to the one or more evaporator assemblies (E). In an embodiment, the actuator mechanism is a motor and pulley assembly coupled to a back plate (12) of the evaporator assembly (E). The actuator mechanism may be selectively operated to move each of the one or more evaporator assemblies (E) between a first position and a second position. The first position corresponds ice forming position which is cooling cycle, and the second position corresponds to harvest position. In the second position, the actuator mechanism moves evaporator assemblies (E) to an angular downward position which eases harvesting of the formed ice. Also, the ice making machine (11) may be employed with a plurality of flaps (14) below the evaporator assembly (E) to direct the tickling liquid to the storage tank (9). In addition, an end (12) of the non-conductive plate (5) is provided with a narrow opening (15) for slowly draining the liquid to assist easy harvest and pre cooling the liquid for next production cycle.

FIGS. 7*a*, 7*b*, 8 and 9 illustrates various views of the evaporator assembly (E) for a vertical flow type ice making machine according to another embodiment of the present disclosure. As shown in FIG. 7*a*, the evaporator assembly (E) may be configured with ice-making regions on both sides of the plurality of tubes (2). In this configuration, the evaporator assembly (E) may include two non-conductive plates (5). Each non-conductive plate (5) may include a pair of vertical walls extending on either side of a plate, thereby separating an ice-making region from a coolant circulation region. Further, a plurality of conductive protrusions (1) may be provided on either side of the plurality of tubes (2), and are thermally coupled to the plurality of tubes (2). In an embodiment, as shown in FIG. 7*a* the plurality of conductive protrusions (1) may be of U-shape. Such that, the ice cubes (8) formed over these conductive protrusions (1) gives small beautiful individual ice cubes (8) as well as when the ice thickness is increased the two set of adjacent ice cubes will join to form a bigger ice cube this way in one machine both smaller as well as bigger ice cubes may be achieved by changing the ice thickness selection.

Figure 8:
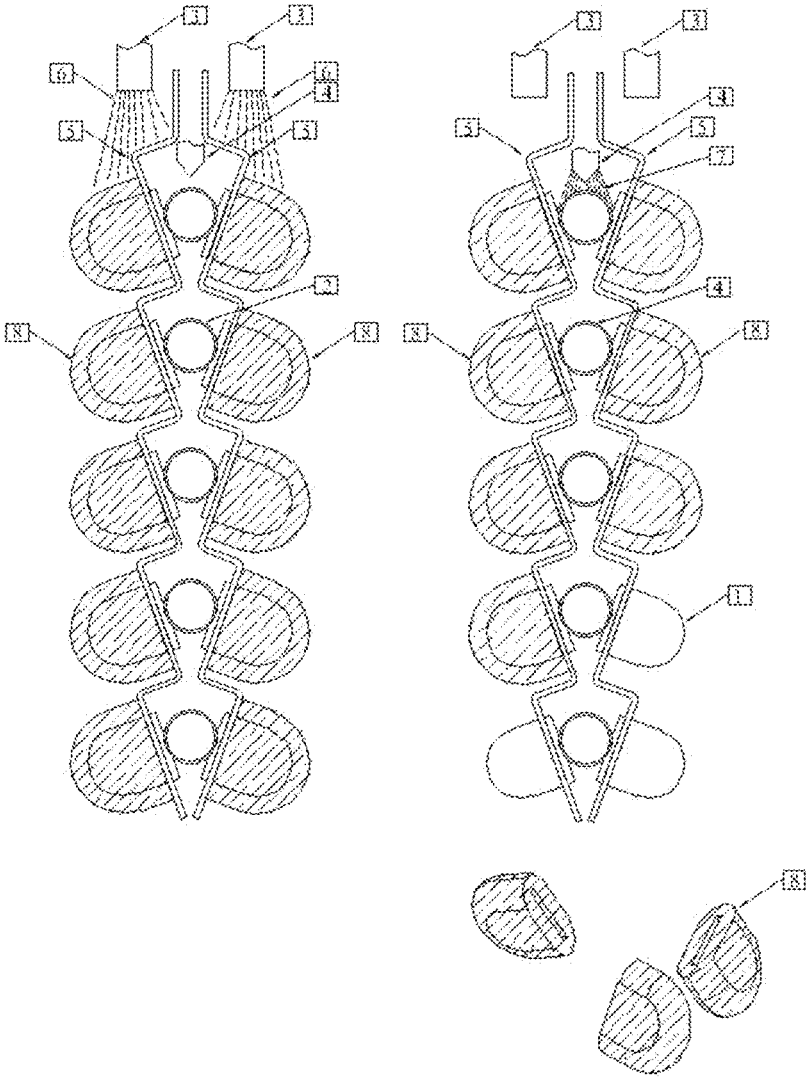
FIG. 8 illustrates the evaporator assembly of FIG. 7*b* in ice forming and harvest cycles.
Figure 9:
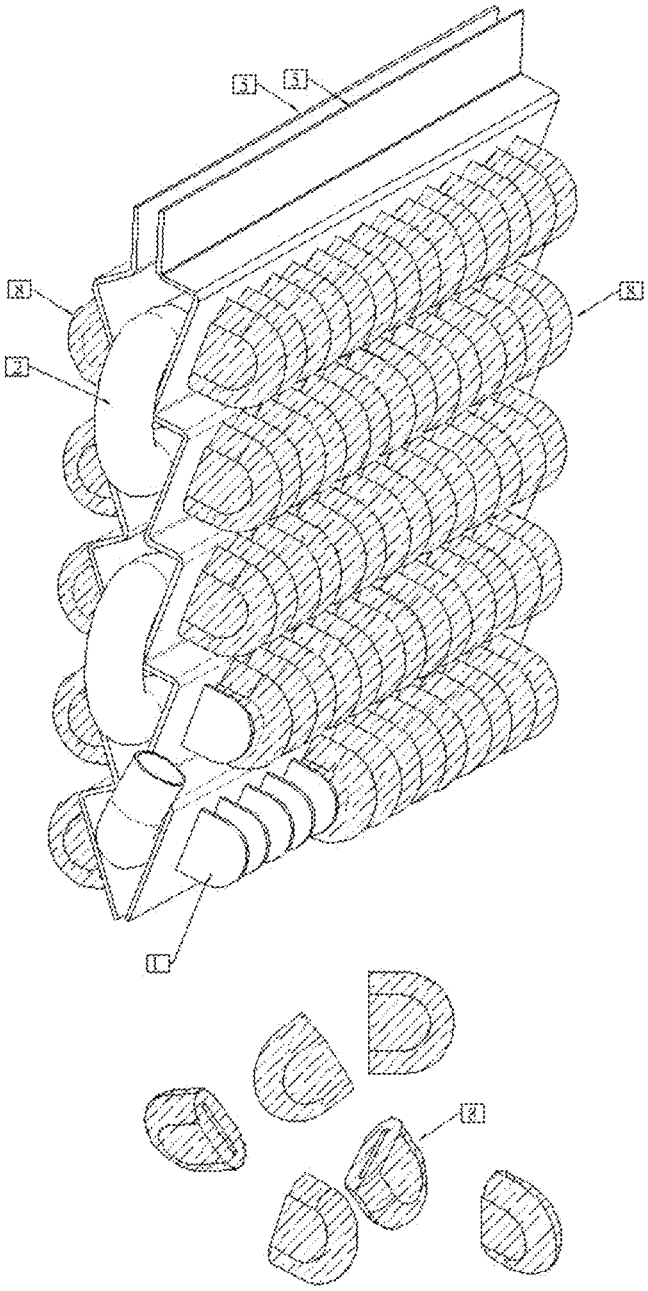
FIG. 9 illustrates evaporator assembly of FIG. 7*a* in the ice harvest cycle.

Also, as shown in FIG. 8 two liquid supplying channels (3) may be provided in the evaporator assembly (E) for supplying the liquid to the corresponding side during cooling/ice forming cycle. In an embodiment of the disclosure, the liquid supplying channels (3) may be impinges, nozzles, and the like. The ice cubes (8) may be formed on both the sides of the evaporator assembly (E), by tickling of liquid from top surface to the other regions. For harvesting the ice cubes (8), a warm coolant may be supplied through the plurality of tubes (2), which heats the conductive protrusions (1) and causes the surrounding ice to melt. At the same time, defrost liquid (7) like warm water may be made to flow at the back of the non-conductive plates (5) through a defrost liquid flow channel (4). As a result, the ice cubes (8) melts free of the respective non-conductive plate (5) which may separate from the respective conductive protrusion (1) due to gravity [as shown in FIG. 9].

Reference is now made to FIGS. 10*a*, 10*b* and 11*a*, 11*b* which are exemplary embodiments of the disclosure illustrating schematic perspective and side views of a vertical flow type ice making machine (11). The configuration of the ice making machine (11) as shown in the FIGS. 10*a*, 10*b* and 11*a*, 11*b* are same as the configuration of the ice making machine (11) shown in FIGS. 5*a*, 5*b* and 6*a*, 6*b*.

FIGS. 12*a*, 12*b* and 13 illustrates various views of the evaporator assembly (E) for a vertical flow type ice making machine (11) according to yet another embodiment of the present disclosure. As shown in FIG. 12*a*, the evaporator assembly (E) may be configured with ice-making regions on both sides of the plurality of tubes (2). In this configuration, the evaporator assembly (E) may include two non-conductive plates (5). Each non-conductive plate (5) may be in the form of a flat plate separating an ice-making region from a coolant circulation region. Further, a plurality of conductive protrusions (1) may be provided on either side of the plurality of tubes (2), and are thermally coupled to the plurality of tubes (2). In an embodiment, as shown in FIG. 12*a* the plurality of protrusions (1) may be of hemispherical-shape. Such that, the ice cubes (8) is formed over these protrusions (1) are in the form of hemisphere.

Also, as shown in FIG. 13 two liquid supplying channels (3) may be provided in the evaporator assembly (E) for supplying the liquid to the corresponding side during cooling/ice forming cycle. The ice cubes (8) may be formed on both the sides of the evaporator assembly (E), by tickling of liquid from top surface of the flat plate to other regions. For harvesting the ice cubes (8), a warm coolant may be supplied through the plurality of tubes (2), which heats the protrusions (1) and causes the surrounding ice to melt. At the same time, defrost liquid (7) like warm water may be made to flow at the back of the non-conductive plates (5) through a defrost liquid flow channel (4). As a result, the ice cubes (8) melts free of the respective non-conductive plate (5) which may separate from the respective conductive protrusion (1) due to the gravity. This configuration of the evaporator assembly (E) may produce small ice cubelets with high efficiency and faster production.

FIGS. 14*a* and 14*b* illustrates perspective view and side view of the evaporator assembly (E) for a vertical flow type ice making machine (11) according to another embodiment of the present disclosure. As shown in FIG. 14*a* the evaporator assembly (E) may be configured with ice-making regions on both sides of the plurality of tubes (2). In this configuration, the evaporator assembly (E) may include two non-conductive plates (5). Further, a plurality of conductive protrusions (1) may be provided on either side of the plurality of tubes (2), and are thermally coupled to the plurality of tubes (2). In an embodiment, as shown in FIG. 14*a* and 14*b* the plurality of protrusions (1) on both the sides are directly coupled to an extending from the corresponding tube of the plurality of tubes (2). Referring to FIGS. 14*c* and 14*d*, the conductive protrusions (1) are thermally joined to the tube (2), such that it covers substantial circumferential portion of the tube (2) to exchange the heat. In an embodiment, the tube (2) is circular in shape, and the conductive protrusions (1) may have semi-circular end which can be accommodated on an outer circumference of the tube on either side, such that the conductive protrusion (1) covers the complete circumference. In an embodiment, the conductive protrusion (1) may be provided on a flange or hub which is mounted on the tube of the plurality of tubes (2). This configuration facilitates large contact area and thereby increase thermal efficiency of the ice making machine.

It is to be noted that the configuration of the ice making machine and the evaporator assembly illustrated in the figures are exemplary embodiments of the present disclosure, and one may vary the configuration depending on the requirement without deviating from the scope of the disclosure. Also, the shapes of the protrusions such as finger shape, U-shape, and hemi-spherical shape illustrated in the figures are exemplary shapes, and one may change the shape of the protrusions depending on shape of ice-cube required.

EQUIVALENTS

With respect to the use of substantially any plural and/or singular terms herein, those having skill in the art can translate from the plural to the singular and/or from the singular to the plural as is appropriate to the context and/or application. The various singular/plural permutations may be expressly set forth herein for sake of clarity.

It will be understood by those within the art that, in general, terms used herein, and especially in the appended claims (e.g., bodies of the appended claims) are generally intended as "open" terms (e.g., the term "including" should be interpreted as "including but not limited to," the term "having" should be interpreted as "having at least," the term "includes" should be interpreted as "includes but is not limited to," etc.). It will be further understood by those within the art that if a specific number of an introduced claim recitation is intended, such an intent will be explicitly recited in the claim, and in the absence of such recitation no such intent is present. For example, as an aid to understanding, the following appended claims may contain usage of the introductory phrases "at least one" and "one or more" to introduce claim recitations. However, the use of such phrases should not be construed to imply that the introduction of a claim recitation by the indefinite articles "a" or "an" limits any particular claim containing such introduced claim recitation to inventions containing only one such recitation, even when the same claim includes the introductory phrases "one or more" or "at least one" and indefinite articles such as "a" or "an" (e.g., "a" and/or "an" should typically be interpreted to mean "at least one" or "one or more"); the same holds true for the use of definite articles used to introduce claim recitations. In addition, even if a specific number of an introduced claim recitation is explicitly recited, those skilled in the art will recognize that such recitation should typically be interpreted to mean at least the recited number (e.g., the bare recitation of"two recitations," without other modifiers, typically means at least two recitations, or two or more recitations). Furthermore, in those instances where a convention analogous to "at least one of A, B, and C, etc." is used, in general such a construction is intended in the sense one having skill in the art would understand the convention (e.g., "a system having at least one of A, B, and C" would include but not be limited to systems that have A alone, B alone, C alone, A and B together, A and C together, B and C together, and/or A, B, and C together, etc.). In those instances where a convention analogous to "at least one of A, B, or C, etc." is used, in general such a construction is intended in the sense one having skill in the art would understand the convention (e.g., "a system having at least one of A, B, or C" would include but not be limited to systems that have A alone, B alone, C alone, A and B together, A and C together, B and C together, and/or A, B, and C together, etc.). It will be further understood by those within the art that virtually any disjunctive word and/or phrase presenting two or more alternative terms, whether in the description, claims, or drawings, should be understood to contemplate the possibilities of including one of the terms, either of the terms, or both terms. For example, the phrase "A or B" will be understood to include the possibilities of "A" or "B" or "A and B."

While various aspects and embodiments have been disclosed herein, other aspects and embodiments will be apparent to those skilled in the art. The various aspects and embodiments disclosed herein are for purposes of illustration and are not intended to be limiting, with the true scope and spirit being indicated by the following claims.

TABLE OF NUMERALS

| Reference Number | Description |
|---|---|
| E | Evaporator assembly |
| 1 | Plurality of protrusions |
| 2 | Plurality of tubes |
| 3 | Liquid flow channel |
| 4 | Defrost liquid flow channel |
| 5 | Non-conductive plate |
| 5a and 5b | Horizontally extending top and bottom portion |
| This5c | Inclined portion |
| 6 | Liquid flow during cooling cycle |
| 7 | Defrost liquid flow during harvest cycle |
| 8 | Ice cubes |
| 9 | Liquid storage tank |
| 10 | Inclined plate |
| 11 | Ice making machine |
| 12 | Back Plate |
| 13 | Guide channel |
| 14 | Flaps |
| 15 | Narrow opening |
| 16 | Pivot |

The invention claimed is:

1. An evaporator assembly for a vertical flow type ice-making machine, the assembly, comprising:

a plurality of tubes for circulating a refrigerant;

a plurality of conductive protrusions thermally coupled to and extending from each of the plurality of tubes, wherein, each of the plurality of conductive protrusions defines an ice-making region; and a non-conductive plate arranged adjacent to the plurality of tubes, the non-conductive plate defines a plurality of zig-zag patterns from one end of the non-conductive plate to another end of the non-conductive plate, and the non-conductive plate defines a plurality of apertures, each aperture from the plurality of apertures accommodating a different conductive protrusion from the plurality of conductive protrusions;

wherein, the plurality of conductive protrusions exchanges heat with the refrigerant flowing through the plurality of tubes and forms ice layer by layer, and a shape of at least one surface of the ice is defined by the non-conductive plate, and wherein, the plurality of conductive protrusions extending from each of the plurality of tubes defines an array, and the plurality of conductive protrusions extending from each of the plurality of tubes is inclined at an angle to an inclined surface of a corresponding zig-zag pattern of the non-conductive plate, such that, each of the plurality of conductive protrusions is perpendicular to the inclined surface of the non-conductive plate.

2. The assembly as claimed in claim 1, wherein each of the plurality of conductive protrusions extends downwardly from a corresponding tube of the plurality of tubes.

3. The assembly as claimed in claim 1, wherein each of the plurality of zig-zag patterns is defined by horizontally extending top and bottom surfaces, and an inclined surface interconnecting the horizontally extending top and bottom surfaces.

4. The assembly as claimed in claim 3, wherein a horizontally extending bottom surface of one zig-zag pattern of the plurality of zig-zag patterns acts as a horizontally extending top surface of an adjacent zig-zag pattern of the plurality of zig-zag patterns.

5. The assembly as claimed in claim 1, wherein the plurality of tubes and the plurality of conductive protrusions are made of material selected from at least one of copper and aluminum.

6. The assembly as claimed in claim 1, wherein the non-conductive plate is made of at least one of polymeric material and a material with low thermal conductivity when compared to material of the plurality of tubes and the plurality of conductive protrusions.

7. The assembly as claimed in claim 3, comprises a plurality of guide channels extending from the horizontally extending top surface of a first zig-zag pattern of the plurality of zig-zag patterns for channelizing a liquid onto the plurality of conductive protrusions.

8. The assembly as claimed in claim 7, wherein each of plurality of guide channels is defined with a curved guide path.

9. A vertical flow type ice-making machine, the machine comprising:

one or more evaporator assemblies, each of the one or more evaporator assembly comprising:

a plurality of tubes for circulating a refrigerant;

a plurality of conductive protrusions thermally coupled to and extending from each of the plurality of tubes, wherein, each of the plurality of conductive protrusions defines an ice-making region; and a non-conductive plate arranged adjacent to the plurality of tubes, the non-conductive plate defines a plurality of zig-zag patterns from one end of the non-conductive plate to another end of the non-conductive plate, and the non-conductive plate defines a plurality of apertures, each aperture from the plurality of apertures accommodating a different conductive protrusion from the plurality of conductive protrusions; and at least one liquid flowing channel positioned in an upstream side of each of the one or more evaporator assemblies for supplying liquid onto the plurality of conductive protrusions;

wherein, the plurality of conductive protrusions exchanges heat with the refrigerant flowing through the plurality of tubes and forms ice layer by layer, and shape of at least one surface of the ice is defined by the non-conductive plate and, wherein, the plurality of conductive protrusions extending from each of the plurality of tubes defines an array, and the plurality of conductive protrusions extending from each of the plurality of tubes is inclined at an angle to an inclined surface of a corresponding zig-zag pattern of the non-conductive plate, such that, each of the plurality of conductive protrusions is perpendicular to the inclined surface of the non-conductive plate.

10. The machine as claimed in claim 9, comprises at least one defrost liquid flow channel positioned in an upstream side of the plurality of tubes for selectively supplying hot fluid onto the plurality of tubes.

11. The machine as claimed in claim 10, wherein the plurality of zig-zag patterns facilitates tickling of the liquid supplied by the at least one liquid flowing channel from one end to the other end of the non-conductive plate.

12. The machine as claimed in claim 9, wherein the non-conductive plate defines a narrow opening in the other end of the non-conductive plate.

13. The machine as claimed in claim 9, comprises an actuator mechanism coupled to the one or more evaporator assemblies, wherein, the actuator mechanism selectively operates each of the one or more evaporator assemblies between a first position and a second position.

14. The machine as claimed in claim 13, wherein the first position corresponds to an ice forming position, and the second position corresponds to a harvest position.

* * * * *